US011158918B2

(12) United States Patent
Li et al.

(10) Patent No.: US 11,158,918 B2
(45) Date of Patent: Oct. 26, 2021

(54) BAND-STOP FILTER, TRANSMISSION LINE FOR BAND-STOP FILTER AND MULTIPLEXER

(71) Applicant: CommScope Italy, S.r.l., Agrate Brianza (IT)

(72) Inventors: Xianxiang Li, Suzhou (CN); Yangzhun Lv, Suzhou (CN); Qing Mi, Suzhou (CN); Qiyun Gu, Suzhou (CN); Giuseppe Resnati, Seregno (IT)

(73) Assignee: CommScope Italy, S.r.l., Agrate Brianza (IT)

( * ) Notice: Subject to any disclaimer, the term of this patent is extended or adjusted under 35 U.S.C. 154(b) by 0 days.

(21) Appl. No.: 16/804,024

(22) Filed: Feb. 28, 2020

(65) Prior Publication Data

US 2020/0295423 A1 Sep. 17, 2020

(30) Foreign Application Priority Data

Mar. 14, 2019 (CN) ..... 201910193260.8

(51) Int. Cl.
*H01P 1/202* (2006.01)
*H01P 1/207* (2006.01)
(Continued)

(52) U.S. Cl.
CPC ..... *H01P 1/207* (2013.01); *H01P 1/202* (2013.01); *H01P 1/208* (2013.01); *H01P 3/08* (2013.01); *H01P 7/04* (2013.01)

(58) Field of Classification Search
CPC .. H01P 1/20; H01P 1/201; H01P 1/202; H01P 1/205; H01P 1/2053; H01P 1/207;
(Continued)

(56) References Cited

U.S. PATENT DOCUMENTS 6,078,231 A * 6/2000 Pelkonen ..... H01P 1/2053 333/134
8,072,298 B2 * 12/2011 Kim ..... B23K 26/244 333/202
2018/0277918 A1 9/2018 Joung-Hoe et al.

FOREIGN PATENT DOCUMENTS

CN 101626101 A 1/2010
EP 1315228 5/2003
(Continued)

OTHER PUBLICATIONS

Extended European Search Report, corresponding to European Patent Application No. 20162424.4 (7 pages) (dated Jul. 24, 2020).

*Primary Examiner* — Stephen E. Jones
(74) *Attorney, Agent, or Firm* — Myers Bigel, P.A.

(57) ABSTRACT

A band-stop filter comprises: a housing having a top wall, a bottom wall and at least one side wall, the housing defining an internal cavity; a signal input port and a signal output port that are respectively disposed on one of the at least one side wall; a resonating element that is disposed in the internal cavity and includes a top, a bottom, and a side; and a transmission line that is disposed in the internal cavity and coupled between the signal input port and the signal output port, the transmission line comprising a coupling section that is coupled to the resonating element, wherein the coupling section is configured to surround more than half of the side of the resonating element and not directly contact the housing and the resonating element.

20 Claims, 9 Drawing Sheets

(51) Int. Cl.
*H01P 3/08* (2006.01)
*H01P 7/04* (2006.01)
*H01P 1/208* (2006.01)

(58) Field of Classification Search
CPC ..... H01P 1/208; H01P 1/2082; H01P 1/2084; H01P 1/2086; H01P 7/04; H01P 7/06; H01P 7/10; H01P 7/105
USPC ..... 333/202, 203, 206, 207, 208, 209, 212, 333/219, 219.1, 222, 223, 224, 227, 228, 333/230, 231, 232
See application file for complete search history.

(56) References Cited

FOREIGN PATENT DOCUMENTS

| | | |
|---|---|---|
| GB | 2505138 | 2/2014 |
| WO | 2016072659 | 5/2016 |

* cited by examiner

BAND-STOP FILTER, TRANSMISSION LINE FOR BAND-STOP FILTER AND MULTIPLEXER

CROSS-REFERENCE TO RELATED APPLICATION

The present application claims priority to Chinese Patent Application No. 201910193260.8, filed Mar. 14, 2019, the entire content of which is incorporated herein by reference as if set forth fully herein.

FIELD

The present invention relates to communication systems, and more particularly to a band-stop filter suitable for radio communication systems, a transmission line for a band-stop filter, and a multiplexer including a band-stop filter.

BACKGROUND

Radio communication systems are designed to work in specific frequency bands. For example, in North America, radio communication systems use, among others, the Cell 800 MHz band (whose frequency range is 824~894 MHz), the PCS (Personal Communications Service) 1900 MHz band (whose frequency range is 1850~1990 MHz, hereinafter referred to as the PCS Band) and the AWS (Advanced Wireless Services) 1700 MHz band (whose frequency range is 1710~1755 MHz, hereinafter referred to as the AWS1 band) and the AWS 2100 MHz band (whose frequency range is 2110~2155 MHz, hereinafter referred to as the AWS2 band).

There is a high demand for base stations (hereinafter referred to as a multi-band base stations) that are configured to operate in multiple radio frequency ("RF") bands (for example, the PCS, AWS1, and AWS2 bands). FIG. 1A is a simplified schematic diagram illustrating a conventional multi-band base station in a radio communication system. As shown in FIG. 1A, the multi-band base station may include an antenna 640 that is configured to transmit and receive radio communication signals within multiple RF bands, a radio 610 for a first frequency band (e.g., the PCS band), a radio 620 for a second frequency band (e.g., the AWS1 and AWS2 bands), and a diplexer 630. The radios 610, 620 may also be connected to respective baseband units (not shown). The diplexer 630 is connected to the antenna 640 by an RF transmission path 650 (e.g., a coaxial cable). In some cases, the RF transmission path 650 may be connected to a duplexer (not shown) so that transmit and receive signals can be carried on a single RF transmission path 650. It will be appreciated that the base station may typically include various other equipment (not shown) such as, for example, a power supply, backup batteries, a power bus, an Antenna Interface Signal Group ("AISG") controller and the like.

In a multi-band base station that supports service in the PCS, AWS1, and AWS2 bands, the diplexer 630 is configured to combine signals within the first and second frequency bands into a combined signal when transmitting signals and to separate signals within the first and second frequency bands from one another when receiving signals. In a known implementation, the diplexer 630 may include three band-pass filters for passing signals within the PCS, AWS1, and AWS2 bands, respectively. In another known implementation, the diplexer 630 may include a band-pass filter for passing signals within the PCS band and a band-stop filter for blocking signals within the PCS band and for passing signals within the AWS1/2 bands (which refers to the combination of the AWS1 and AWS2 bands).

FIG. 1B is a perspective view of a conventional band-stop filter in which at least a part of the band-stop filter is shown schematically. The band-stop filter may be used in the diplexer 630 described above. The band-stop filter (including a notch filter) has an input port, an output port, a housing defining an internal cavity, a resonating element disposed in the internal cavity, and a transmission line coupled to the resonating element.

As shown in FIG. 1B, the band-stop filter may include a housing 10 that defines an internal cavity and has a plurality of partitions 11, 12, 13 that extend from side walls of the housing 10 into the internal cavity and extend upwardly from a bottom of the housing 10, such that the partitions 11, 12, 13 divide the internal cavity into a plurality of cavities 20-1 to 20-4. It should be noted that herein, when multiple like or similar elements are provided, each of them may be labeled in the drawings using a two-part reference numeral (e.g., cavity 20-1). Such elements may be referred to herein individually by their full reference numerals (e.g., cavity 20-1) and may be referred to collectively by the first part of their reference numerals (e.g., cavity 20). A mounting portion 15 that is fixed to the bottom of the housing 10 is provided in each of the cavities 20 for mounting a respective resonating element.

Resonating elements 40 are disposed in each cavity 20 by being fixed to the respective mounting portions 15. In the example shown in FIG. 1B, the resonating element for cavity 20-1 is omitted to better illustrate the mounting portion 15. The resonating elements 40-1 to 40-3 are disposed in the cavities 20-2 to 20-4, respectively. Any of the resonating elements 40 may comprise, for example, dielectric resonating elements or coaxial metal resonating elements. The band-stop filter further includes a frequency tuning element 41 for each resonating element 40. A resonant frequency of each resonating element 40 may be tuned by adjusting its associated frequency tuning element 41.

The band-stop filter further includes a transmission line 30. The transmission line 30 is coupled between an input port (not shown) and an output port (not shown) of the band-stop filter. Transmission line 30 includes coupling sections 31 that are disposed adjacent one side of each resonating element 40 so as to be coupled to the respective resonating element 40. The transmission line 30 further includes a mounting section 32 that is secured to a clamping portion 14 provided by the housing 10 such that the transmission line 30 is mounted in the internal cavity defined by the housing 10.

The top wall (not shown) of the housing 10 may be mounted by fitting screws to mounting holes 16 such that the internal cavity defined by the housing 10 is isolated from outside. After the top wall is mounted, the partitions 11, 12, 13 are in close contact with the top wall, so that the isolation between these cavities 20 meets design requirements for the filter. The resonating elements 40 each resonate at their respective resonant frequencies in the respective cavities 20.

Various aspects of the frequency response of the band-stop filter may be adjusted by tuning the resonance frequency of each of the resonating elements 40 and the coupling between the transmission line 30 and each of the resonating elements 40.

SUMMARY

A first aspect of this invention provides a band-stop filter. The band-stop filter may comprise: a housing comprising a top wall, a bottom wall and at least one side wall, the housing defining an internal cavity; a signal input port that is disposed on one of the at least one side wall; a signal output port that is disposed on one of the at least one side wall; a resonating element that is disposed in the internal cavity and includes a top, a bottom, and a side; and a transmission line that is disposed in the internal cavity and coupled between the signal input port and the signal output port, the transmission line comprising a coupling section that is coupled to the resonating element, wherein the coupling section is configured to surround more than half of the side of the resonating element and not directly contact the housing and the resonating element.

A second aspect of this invention is to provide a transmission line for a band-stop filter. The band-stop filter may include a housing that defines an internal cavity, a signal input port and a signal output port that are disposed on the housing, and a resonating element and a transmission line that are disposed in the internal cavity. The transmission line may be coupled between the signal input port and the signal output port and includes a coupling section that is configured to be substantially parallel to a bottom wall of the housing, substantially annular, and to completely surround a side of the resonating element, and to not directly contact the housing and the resonating element, such that the transmission line is coupled to the resonating element through the coupling section.

A third aspect of this invention is to provide a band-stop filter. The band-stop filter may comprise: a housing defining an internal cavity; a signal input port on the housing; a signal output port on the housing; a resonating element in the internal cavity; and a transmission line in the internal cavity and coupled between the signal input port and the signal output port, the transmission line including a coupling section and being coupled to the resonating element through the coupling section, wherein the coupling section includes a first portion that partially surrounds the resonating element on a first side thereof and a second portion that partially surrounds the resonating element on a second side thereof that is opposite the first side, and a first end of the first portion and a first end of the second portion are connected by a first joint.

A fourth aspect of this invention is to provide a multiplexer. The multiplexer may comprise: a band-pass filter configured to pass signals within a first frequency band and block signals within other frequency bands; a band-stop filter as described above, configured to block at least signals within the first frequency band and pass at least signals within second and third frequency bands, wherein the second frequency band is lower than the first frequency band and the third frequency band is higher than the first frequency band; a signal input; a first output that is coupled to the signal input via the band-pass filter; and a second output that is coupled to the signal input via the band-stop filter.

A fifth aspect of this invention is to provide a method of self-adjusting a coupling between a transmission line and a resonating element in a band-stop filter. The method may comprise: configuring at least a section of the transmission line to completely surround a side of the resonating element and not directly contact the resonating element, such that the transmission line is coupled to the resonating element.

Figure 1A:
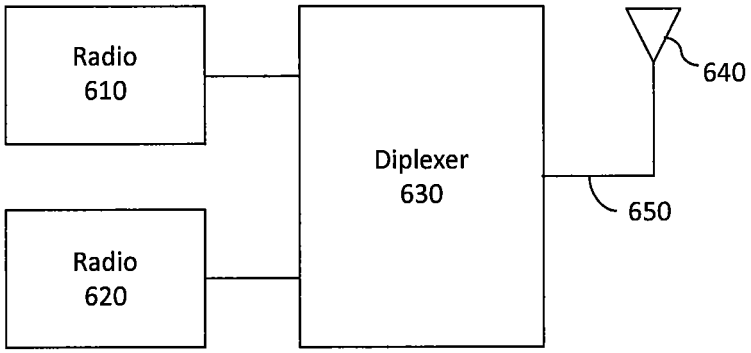
FIG. 1A is a simplified schematic diagram illustrating a conventional multi-band base station in a radio communication system.

In order to facilitate understanding, the position, size, range, or the like of each structure illustrated in the drawings may not be drawn to scale. Thus, the invention is not necessarily limited to the position, size, range, or the like as disclosed in the drawings.

DETAILED DESCRIPTION

The present invention will be described with reference to the accompanying drawings, which show a number of example embodiments thereof. It should be understood, however, that the present invention can be embodied in many different ways, and is not limited to the embodiments described below. Rather, the embodiments described below are intended to make the disclosure of the present invention more complete and fully convey the scope of the present invention to those skilled in the art. It should also be understood that the embodiments disclosed herein can be combined in any way to provide many additional embodiments.

The terminology used herein is for the purpose of describing particular embodiments, but is not intended to limit the scope of the present invention. All terms (including technical terms and scientific terms) used herein have meanings commonly understood by those skilled in the art unless otherwise defined. For the sake of brevity and/or clarity, well-known functions or structures may be not described in detail.

Herein, when an element is described as located "on" "attached" to, "connected" to, "coupled" to or "in contact with" another element, etc., the element can be directly located on, attached to, connected to, coupled to or in contact with the other element, or there may be one or more intervening elements present. In contrast, when an element is described as "directly" located "on", "directly attached"

to, "directly connected" to, "directly coupled" to or "in direct contact with" another element, there are no intervening elements present. In the description, references that a first element is arranged "adjacent" a second element can mean that the first element has a part that overlaps the second element or a part that is located above or below the second element.

Herein, the foregoing description may refer to elements or nodes or features being "connected" or "coupled" together. As used herein, unless expressly stated otherwise, "connected" means that one element/node/feature is electrically, mechanically, logically or otherwise directly joined to (or directly communicates with) another element/node/feature. Likewise, unless expressly stated otherwise, "coupled" means that one element/node/feature may be mechanically, electrically, logically or otherwise joined to another element/node/feature in either a direct or indirect manner to permit interaction even though the two features may not be directly connected. That is, "coupled" is intended to encompass both direct and indirect joining of elements or other features, including connection with one or more intervening elements.

Herein, terms such as "upper", "lower", "left", "right", "front", "rear", "high", "low" may be used to describe the spatial relationship between different elements as they are shown in the drawings. It should be understood that in addition to orientations shown in the drawings, the above terms may also encompass different orientations of the device during use or operation. For example, when the device in the drawings is inverted, a first feature that was described as being "below" a second feature can be then described as being "above" the second feature. The device may be oriented otherwise (rotated 90 degrees or at other orientation), and the relative spatial relationship between the features will be correspondingly interpreted.

Herein, the term "A or B" used through the specification refers to "A and B" and "A or B" rather than meaning that A and B are exclusive, unless otherwise specified.

The term "exemplary", as used herein, means "serving as an example, instance, or illustration", rather than as a "model" that would be exactly duplicated. Any implementation described herein as exemplary is not necessarily to be construed as preferred or advantageous over other implementations. Furthermore, there is no intention to be bound by any expressed or implied theory presented in the detailed description.

Herein, the term "substantially", is intended to encompass any slight variations due to design or manufacturing imperfections, device or component tolerances, environmental effects and/or other factors. The term "substantially" also allows for variation from a perfect or ideal case due to parasitic effects, noise, and other practical considerations that may be present in an actual implementation.

Herein, certain terminology, such as the terms "first", "second" and the like, may also be used in the following description for the purpose of reference only, and thus are not intended to be limiting. For example, the terms "first", "second" and other such numerical terms referring to structures or elements do not imply a sequence or order unless clearly indicated by the context.

Further, it should be noted that, the terms "comprise", "include", "have" and any other variants, as used herein, specify the presence of stated features, steps, operations, elements, and/or components, but do not preclude the presence or addition of one or more other features, steps, operations, elements, components, and/or groups thereof.

Embodiments of the present invention provide band-stop filters, which may be used as stand-alone devices or which may be used to form a duplexer, a diplexer, a combiner/splitter, and/or a multiplexer/demultiplexer, etc. Embodiments of the present invention further provide a multiplexer in which the band-stop filter is applied and a transmission line for the band-stop filter. Embodiments of the present invention further provide a RF device including a multiplexer that includes the band-stop filter. Some embodiments of the present invention are described based on the RF device.

Figure 1B:
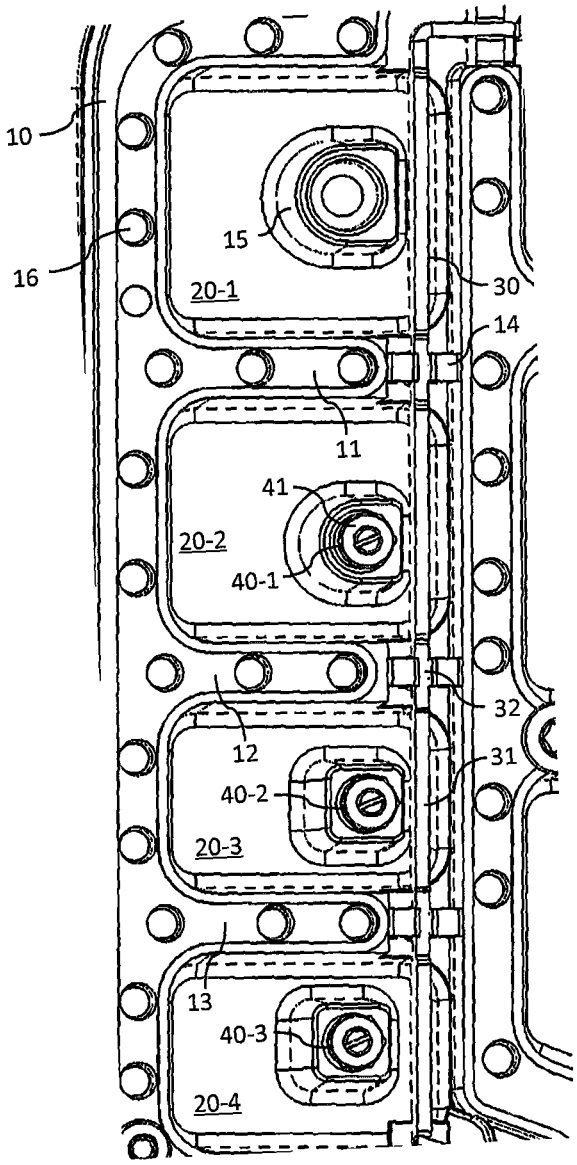
FIG. 1B is a perspective view of a conventional band-stop filter in which at least a part of the band-stop filter is shown schematically.

A band-stop filter according to an embodiment of the invention includes a transmission line whose coupling section is configured to surround more than half a side of a resonating element so that the transmission line is coupled to the resonating element. Compared with the conventional band-stop filter shown in FIG. 1B in which the coupling section is adjacent only one side of the resonating element, the band-stop filter according to an embodiment of the invention increases the coupling area between the transmission line and the resonating element, so that greater coupling strength may be obtained with the same spacing between the transmission line and the resonating element, which helps to provide a better frequency response for the band-stop filter; and the same coupling strength may be obtained with increased spacing between the transmission line and the resonating element, which facilitates manufacture and assembly of the band-stop filter.

In some embodiments, the coupling section of the transmission line is configured to completely surround the side of the resonating element, such that the band-stop filter may self-adjust to the coupling between the transmission line and the resonating element. For example, when a longitudinal axis of the resonating element is not well aligned with the center of the coupling section, the same coupling as that when the longitudinal axis of the resonating element passes directly through the center of the coupling section may be obtained. Thus, the requirements for manufacturing and assembling the transmission line and the resonating element may be less stringent. In some embodiments, a connecting section of the transmission line for connecting two adjacent coupling sections has one or more bends, such that the physical distance between the two adjacent resonating elements may be reduced when the electrical distance between the two is predetermined, which is advantageous in reducing the volume of the band-stop filter. In some embodiments, the coupling section is configured to be substantially annular (i.e., ring-shaped) so as to completely surround the resonating element, such that the coupling section has substantially the same characteristics at various points of the circumference of the ring, and thus, a joint of the connecting section and the coupling section may be placed anywhere on the circumference based on design requirements of the filter, which facilitates the layout of the filter and the routing of the transmission line. In some embodiments, the transmission line is a substantially flat conductor that is easy to manufacture.

Figure 2:
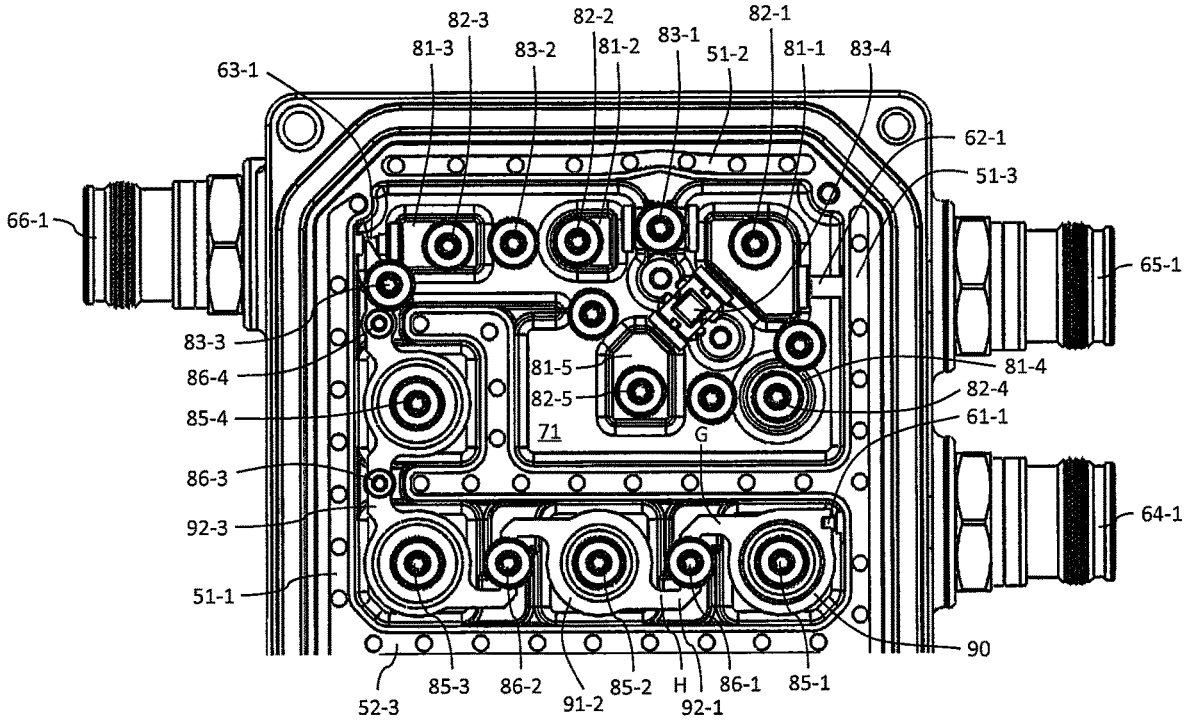
FIG. 2 is a top view of a portion of a RF device including a multiplexer according to an embodiment of the present invention, wherein the multiplexer includes a band-stop filter according to an embodiment of the present invention, and at least part of the multiplexer and at least part of the band-stop filter is shown.
Figure 3:
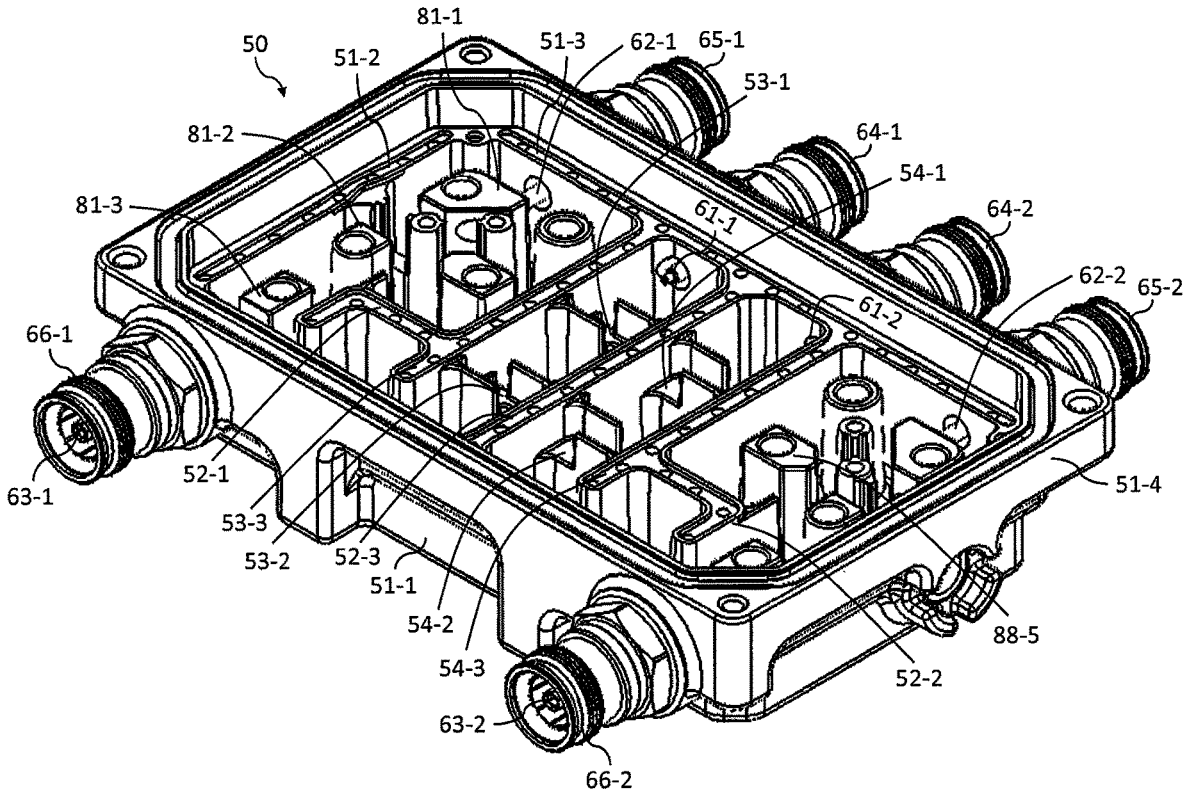
FIG. 3 is a perspective view of the RF device shown in FIG. 2 with resonating elements, coupling tuning elements, and the transmission line removed.
Figure 4:
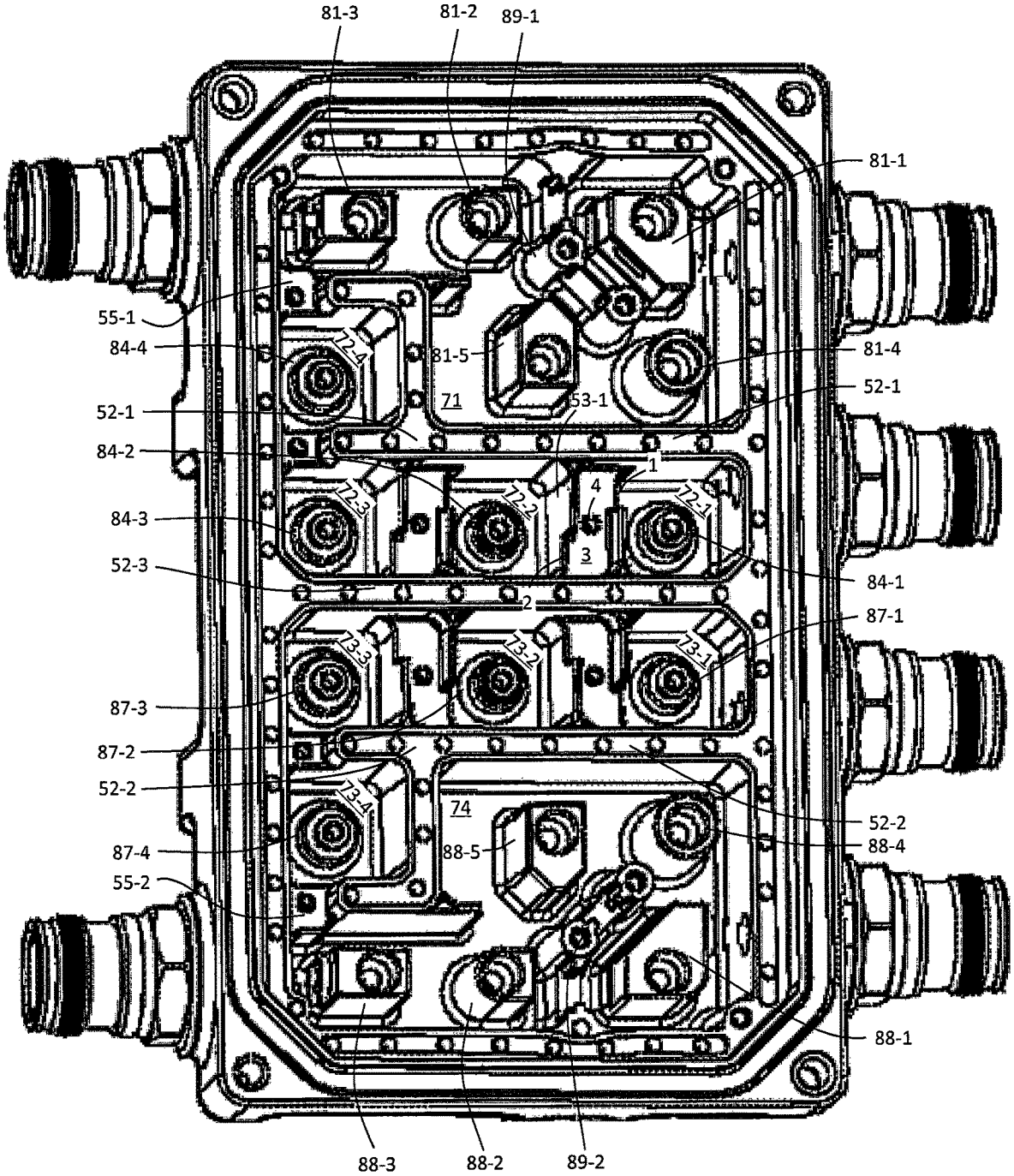
FIG. 4 is another perspective view of the RF device shown in FIG. 2 with resonating elements, coupling tuning elements, the transmission line, the input port and the output port removed.
Figure 5:
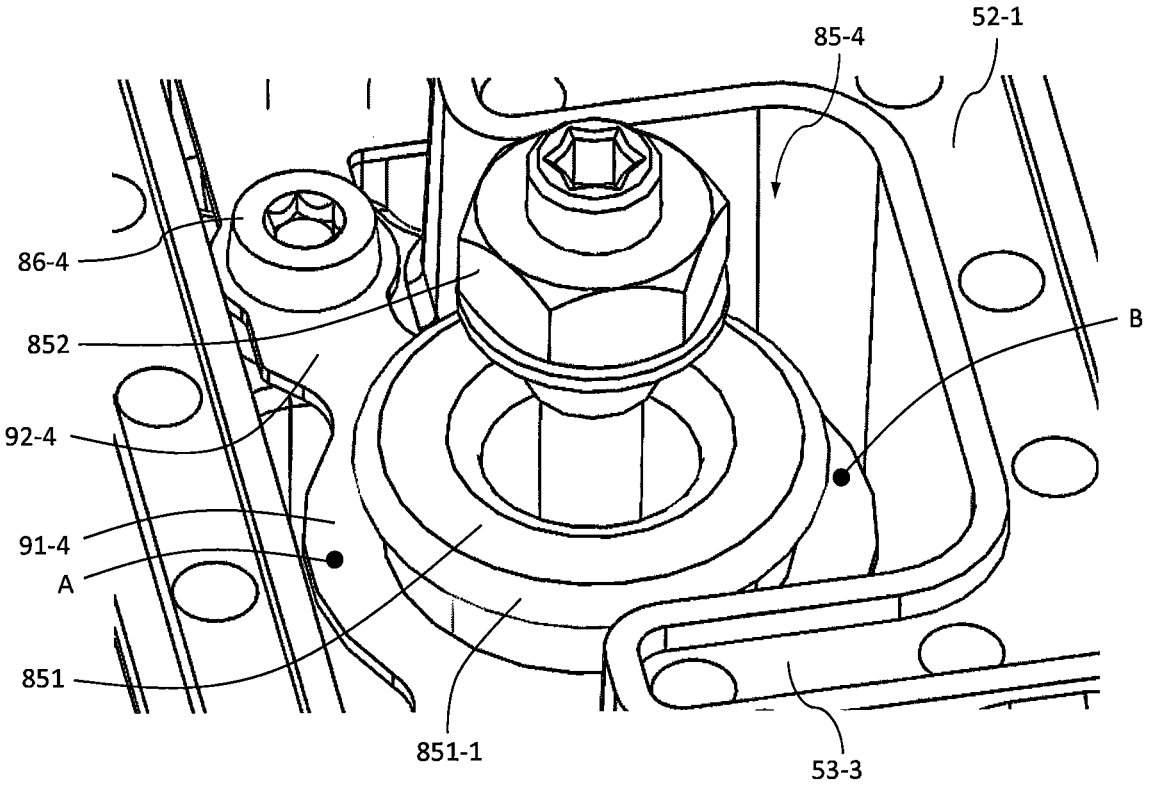
FIG. 5 is a greatly enlarged partial perspective view of the RF device shown in FIG. 2.
Figure 6:
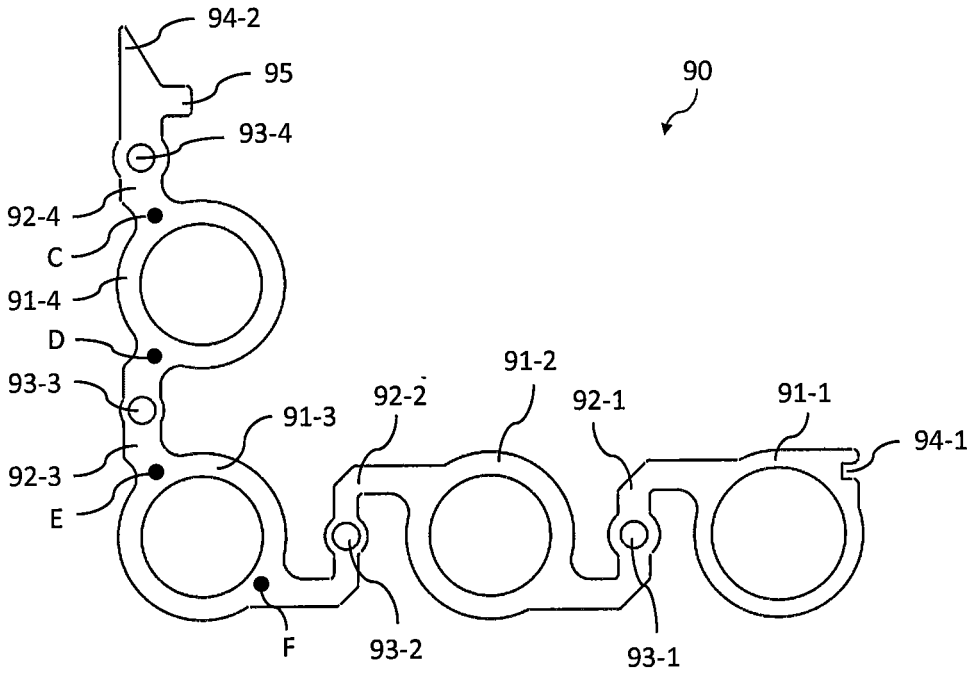
FIG. 6 is a plan view of the transmission line in the RF device shown in FIG. 2, where the transmission line is a transmission line according to an embodiment of the present invention.

Referring to FIGS. 2 through 6, an RF device according to embodiments of the present invention will be described. FIG. 2 is a top view of a portion of the RF device, which includes a multiplexer according to an embodiment of the present invention. The multiplexer includes a band-stop filter and at least part of the multiplexer and at least part of the band-stop filter are shown in the top view of FIG. 2. FIG. 3 is a perspective view of the RF device shown in FIG. 2 with resonating elements, coupling tuning elements, and the transmission line removed. FIG. 4 is another perspective view of the RF device shown in FIG. 2 with resonating elements, coupling tuning elements, the transmission line, the input port and the output port removed. FIG. 5 is a partially enlarged perspective view of the RF device shown in FIG. 2. FIG. 6 is a plan view of the transmission line in the RF device shown in FIG. 2.

Referring first to FIG. 3, a RF device according to an embodiment of the present invention comprises a housing 50 including a top wall (not shown), a bottom wall and side walls 51 that define an internal cavity. The housing 50 further includes partitions 52 that extend from the side walls 51 into the internal cavity and that extend upwardly from the bottom wall. The internal cavity is divided by the partitions 52 into a total of four portions (see FIG. 4) which are cavities 71, 72, 73 and 74, respectively. As shown in FIGS. 3 and 4, the partition 52-1 and the side walls 51-1, 51-2 and 51-3 define the cavity 71. The partition 52-1, the side walls 51-1 and 51-3 and the partition 52-3 define the cavity 72. The partition 52-3, the side walls 51-1 and 51-3 and the partition 52-2 define the cavity 73. The partition 52-2 and the side walls 51-1, 51-3 and 51-4 define the cavity 74. The cavity 71 is used to form a first band-pass filter, the cavity 72 is used to form a first band-stop filter, the cavity 73 is used to form a second band-stop filter, and the cavity 74 is used to form a second band-pass filter. After the top wall of the housing 50 is mounted in position, the side walls 51 and the partitions 52 are in close contact with the top wall such that the cavities 71 through 74 each are substantially closed.

The RF device further includes a plurality of signal input/output ports 61, 62, 63 that extend through the side walls 51. Port 63-1 extends through side wall 51-1, and port 61-1 extends through side wall 51-3 that is opposite the side wall 51-1. Port 63-1 is coupled to port 61-1 through the first band-stop filter. Port 62-1 extends through side wall 51-3, and port 63-1 is coupled to port 62-1 through the first band-pass filter. The first band-pass filter and the first band-stop filter share port 63-1. When a signal is input at port 63-1, a first component of the signal within a passband of the first band-pass filter is output through port 62-1, and a second component within passbands of the first band-stop filter is output through port 61-1. When signals are input at ports 61-1 and 62-1, a combined signal that includes a first signal within a passband of the first band-pass filter and a second signal within passbands of the first band-stop filter are output through port 63-1.

Port 63-2 extends through side wall 51-1, and ports 61-2 and 62-2 extend through side wall 51-3. Port 61-2 is coupled to port 63-2 through a second band-stop filter, and port 62-2 is coupled to port 63-2 through a second band-pass filter. When a signal is input at port 63-2, a first component of the signal within a passband of the second band-pass filter is output through port 62-2, and a second component within passbands of the second band-stop filter is output through port 61-2. When signals are input at ports 61-2 and 62-2, a combined signal that includes a first signal within a passband of the second band-pass filter and a second signal within passbands of the second band-stop filter are output through port 63-2

Portions of the ports 61, 62, 63 that extend outside the housing 50 are provided with connectors 64, 65, 66 (e.g., threaded connectors, flanges, etc.) for connecting to other equipment. For example, the connectors 64, 65, 66 may be implemented as coaxial connectors that mate with coaxial cables, and the ports 61, 62, 63 may be implemented as conductors that can be electrically connected to center conductors of the coaxial cables.

According to the above descriptions, the first band-pass filter, the first band-stop filter and the corresponding ports form a first three-port device (for example, may be applied as a combiner/splitter, a diplexer/de-diplexer), and the second band-pass filter, the second band-stop filter and the corresponding ports form a second three-port device. After the top wall of the housing 50 is mounted in position, the first and second three-port devices, are substantially isolated from each other since the middle partition 52-3 continuously contacts the top wall, so that the first and second three-port devices may each operate independently. Although the configurations of the first and second three-port devices are almost identical in the embodiment shown in the figures, it will be appreciated that the first and second three-port devices that operate independently may have different configurations. In addition, transmission directions of signals in the first and second three-port devices may also be different.

Figure 9A:
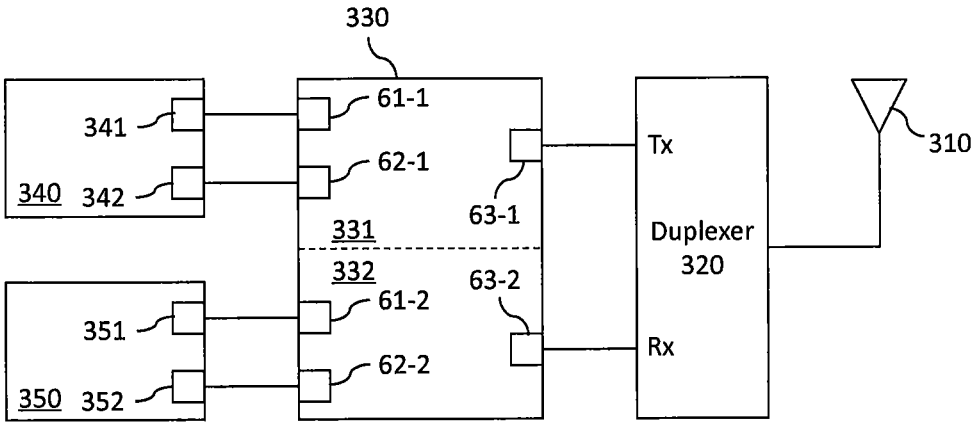
FIGS. 9A through 9C are schematic block diagrams showing applications of the RF device shown in FIG. 2.
Figure 9B:
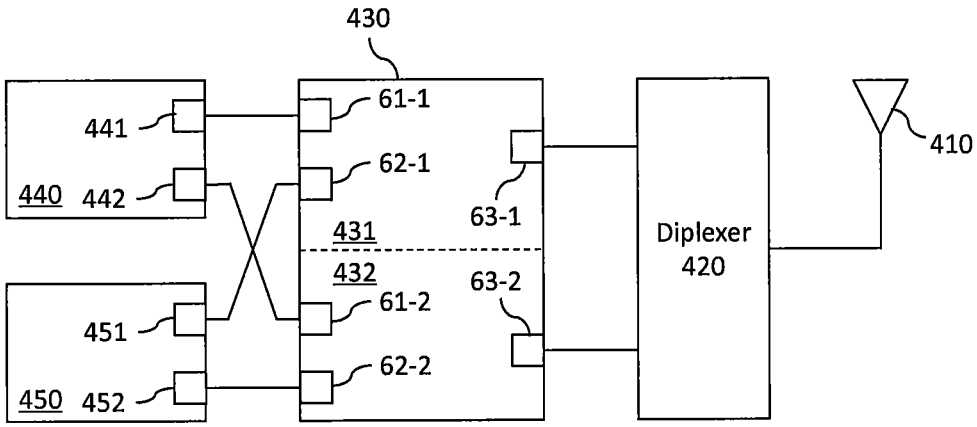
Figure 9C:
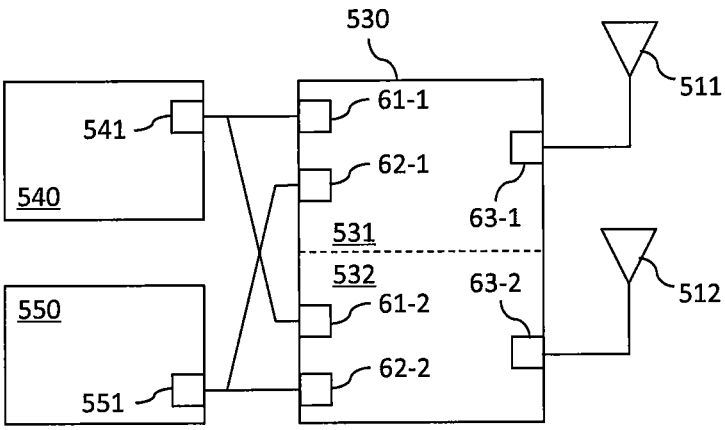

Some application examples of the RF device are shown in FIGS. 9A through 9C. As shown in FIG. 9A, in one example, a first three-port device 331 in an RF device 330 may be used in a signal transmitting channel, and a second three-port device 332 may be used in a signal receiving channel. A duplexer 320 is connected between an antenna 310 and the RF device 330. A transmitting channel port Tx of the duplexer 320 is connected to port 63-1 of the first three-port device 331 of the RF device 330. Ports 61-1, 62-1 of the first three-port device 331 are respectively connected to two ports 341, 342 of the radio transmitter 340. The two ports 341, 342 may be used for signals within different frequency bands. A receiving channel port Rx of the duplexer 320 is connected to port 63-2 of the second three-port device 332 of the RF device 330. Ports 61-2, 62-2 of the second three-port device 332 are respectively connected to two ports 351, 352 of the radio receiver 350. The two ports 351, 352 may be used for signals within different frequency bands. For example, in a multi-band base station supporting the PCS and AWS1/2 bands, a first band-pass filter in the first three-port device 331 is used to pass signals within the PCS band, a first band-stop filter is used to block at least signals within the PCS band and to pass at least signals within the AWS1/2 bands. The port 342 of the radio transmitter 340 outputs a signal within the PCS band to the port 62-1 of the first three-port device 331, and the port 341 outputs a signal within the AWS1/2 bands to the port 61-1. A combined signal of the PCS and AWS1/2 bands is output at the port 63-1 of the first three-port device 331, and passed to the antenna 310 through the duplexer 320 for transmitting. A signal received by the antenna 310 pass through the duplexer 320 and enters the second three-port device 332 via the receiving channel port Rx and the port 63-2. A first signal component of the received signal that is within the PCS band is output from the port 62-2 to the port 352 of the radio receiver 350, and a second signal component that is within the AWS1/2 bands is output from the port 61-2 to the port 351. Since the first and second three-port devices 331 and 332 operate in the same frequency bands in this example, the duplexer 320 may be configured as a time division duplex (TDD) device. In other examples not shown in the figures, the first and second three-port devices 331 and 332 may operate in different frequency bands, and the duplexer 320 may be configured as either a frequency division duplex (FDD) or a TDD device.

In a further example, as shown in FIG. 9B, a first three-port device 431 and a second three-port device 432 in an RF device 430 may both be used for signal transmitting and/or receiving. Radio 440 may provide signals within the AWS1/2 bands and radio 450 may provide signals within the PCS band. Two ports 441 and 442 of the radio 440 may respectively output signals within the AWS1/2 bands having first and second polarizations, and are respectively connected to port 61-1 of the first three-port device 431 and port 61-2 of the second three-port device 432. Two ports 451 and 452 of the radio 450 may respectively output signals within the PCS band having first and second polarizations, and are respectively connected to port 62-1 of the first three-port device 431 and port 62-2 of the second three-port device 432. The first three-port device 431 outputs a first combined signal having the first polarization from the port 63-1, and the second three-port device 432 outputs a second combined signal having the second polarization from the port 63-2. The first and second combined signals may be multiplexed by the diplexer 420 and transmitted to the antenna 410.

In a further example, as shown in FIG. 9C, a base station may include more than one antenna. Two antennas 511 and 512 are shown in the figure. A first three-port device 531 and a second three-port device 532 in an RF device 530 may be used for the antennas 511 and 512, respectively. Port 541 of radio 540 that provides signals within the AWS1/2 bands is coupled to ports 61-1 and 61-2 (e.g., via a power coupler), and port 551 of radio 550 that provides signals within the PCS band is coupled to port 62-1 and 62-2. The first and second three-port devices 531, 532 respectively output combined signals that are supplied to the antennas 511, 512 from ports 63-1, 63-2, respectively.

Moreover, although not shown in the drawings, it will be appreciated that each of the three-port devices in the RF device may operate as a duplexer with the band-pass filter and the band-stop filter respectively pass signals within different frequency bands. In addition, when the first three-port device and the second three-port device operate in different frequency bands, the RF device itself may also operate as a duplexer.

It should be noted that "input" and "output" in the descriptions for the two examples of FIGS. 9B and 9C describe the case when the base station transmits RF signals. It will be appreciated that when the base station receives RF signals, the "input" and "output" in these descriptions may operate as "output" and "input", respectively.

Although a RF device including two three-port devices (each of which includes a band-pass filter and a band-stop filter) is described above with reference to FIGS. 2 through 6, it will be appreciated that RF devices according to other embodiments of the present invention may include only one three-port device or more than two three-port devices. Further, although an input port and an output port of each three-port device in the RF device shown in FIGS. 2 through 6 are disposed on opposite side walls, it will be appreciated that the input port and the output port of each three-port device may be disposed on adjacent side walls, or on a same side wall.

The band-pass filter and the band-stop filter included in the RF device will be described below with reference to FIGS. 2 through 6 again.

The first band-pass filter is formed in cavity 71. The first band-pass filter includes resonating elements 81-1 through 81-5 and frequency tuning elements 82-1 through 82-5 (e.g., frequency tuning screws). The resonating elements 81 are formed on the bottom wall of the housing 50 and extend upwardly. The resonating elements 81 may be integrally formed on the bottom wall of the housing 50 or may be mounted to the bottom wall. The interior of each of the resonating elements 81 includes a cavity and each of the resonating elements 81 has an upward opening. Each of the frequency tuning elements 82 is configured to be inserted to a variable depth into the cavity formed by a respective resonating element 81 so as to tune a resonant frequency of the resonating element 81, respectively. In addition, the first band-pass filter further includes coupling tuning elements (e.g., coupling tuning screws), such as coupling tuning elements 83-1, 83-2 for respectively adjusting coupling between a pair of adjacent resonating elements 81, and coupling tuning element 83-4 for adjusting coupling between a pair of non-adjacent resonating elements 81 (e.g., resonating elements 81-1 and 81-5). The port 62-1 of the first band-pass filter may be coupled to the resonating element 81-1. For example, when port 62-1 is implemented as a conductor, the conductor may insert into the cavity formed by the resonating element 81-1 to pass signals. The port 63-1 may be coupled to resonating element 81-3 to pass signals. In the illustrated embodiment, a mounting portion 89-1 (a mounting portion of the second band-pass filter is shown as 89-2) extending upwardly is provided on the bottom wall. Threaded holes are formed in the mounting portions 89 which are used to mount the top wall.

The first band-stop filter is formed in the cavity 72. The housing 50 further includes partitions 53 extending upwardly from the bottom wall into the cavity 72 to divide the cavity 72. A partition 53-1 together with the side wall 51-3 and the partitions 52-1, 52-3 defines a cavity 72-1. A partition 53-2 together with the partitions 52-1, 52-3, 53-1 defines a cavity 72-2. A partition 53-3 together with the side wall 51-1 and the partitions 53-2, 52-3 defines a cavity 72-3. The partition 53-3 together with the side wall 51-1 and the partition 52-1 define a cavity 72-4. The upper end of the partition 53-1 is provided with a recess 3 to accommodate a transmission line 90. After the top wall of the housing 50 is mounted in position, since the portion of the upper end of the partition 53-1 other than the recess 3 contacts the top wall, the cavities 72 are substantially isolated from one another and each form substantially closed spaces. Mounting portions 84-1 through 84-4 for mounting resonating components 85-1 through 85-4 are respectively disposed in each of the cavities 72-1 through 72-4. The mounting portion 84 may be integrally formed on the bottom wall of the housing 50 or may be mounted to the bottom wall. The resonating components 85 are positioned and operate in respective cavities 72 through being mounted to respective mounting portions 84. The first band-stop filter further includes the transmission line 90 disposed in the cavity 72 and coupled to resonating elements of the resonating components 85. The transmission line 90 passes through cavities 72-1 through 72-4 sequentially and is coupled between ports 61-1 and 63-1.

Ends 94-1 and 94-2 of the transmission line 90 are formed to facilitate coupling to the ports 61-1 and 63-1, respectively. For example, the end 94-1 forms a recess and the port 61-51 that is implemented as a conductor may be inserted into the recess so as to be coupled to the transmission line 90. The width of the end 94-2 is gradually reduced and may be positioned on the upper surface of the port 63-1 so as to be coupled to the port 63-1. In the illustrated embodiment, the two ends 94-1 and 94-2 of the transmission line 90 are in electrical contact with the conductors of the ports 61-1 and 63-1, respectively, such that the coupling is implemented as a galvanic connection so that the transmission line 90 may also pass lower frequency signals and DC signals in addition to higher frequency signals. The lower frequency signals or DC signals may be, for example, a power supply signal, a detection signal, and a control signal (for example, a control signal sent from a remote location by an operator to control the antenna to adjust its pointing direction). It will be appreciated that the transmission line 90 may also be coupled between ports 61-1 and 63-1 in other known ways.

Since portions of the first band-stop filter within the cavities 72 are similar, FIG. 5 only shows the portion of the first band-stop filter within the cavity 72-4, and those skilled in the art can obtain the portions within other cavities 72 from FIG. 5 and other figures.

The resonating component 85-4 includes a resonating element 851 and a frequency tuning screw 852. The resonating element 851 is mounted to the mounting portion 84-4 that is positioned in the cavity 72-4 and does not contact the sidewall of the cavity 72-4. A cavity is formed in the interior of the resonating element 851 and the resonating element 851 has an upward opening. The frequency tuning screw 852 is configured to be inserted to a variable depth within the cavity formed by the resonating element 851 to tune a resonant frequency of the resonating element 851 such that the resonating element 851 that is positioned in the substantially closed cavity 72-4 resonates at a desired resonant frequency. It will be appreciated that a corresponding location on the top wall of the housing 50 is provided with a mounting hole to allow the frequency tuning screw 852 to be inserted into the cavity formed by the resonating element 851 to a desired depth after being mounted into the mounting hole.

The transmission line 90 includes four coupling sections 91-1 through 91-4 and four connecting sections 92-1 through 92-4. Each coupling section 91 may be configured to have a substantially annular shape that completely surrounds a sidewall of a respective resonating element (e.g., the resonating element 851), and the coupling section 91 is not in direct contact with the housing 50 and/or the resonating element, such that the transmission line 90 is electromagnetically coupled to the resonating element through the coupling section 91. In the illustrated embodiment, the upper edge of the upward opening of the resonating element 851 has an outward flange 851-1 whose lower surface is opposite an upper surface of the coupling section 91-4. In some embodiments, the flange 851-1 and the coupling section 91-4 have an overlapping portion in a plan view that is parallel to the bottom wall. This increases the coupling area between the resonating element 851 and the coupling section 91-4, so that a greater coupling strength may be obtained with the same spacing between the coupling section 91-4 and the resonating element 851 and the same coupling strength may be obtained with appropriately increasing the spacing between the coupling section 91-4 and the resonating element 851 compared with a conventional design.

The resonating element 851 is a coaxial resonating element whose longitudinal axis is substantially perpendicular to the bottom wall, and a plane of the coupling section 91-4 is substantially parallel to the bottom wall. In some cases, the resonating element 851 and the coupling section 91-4 are positioned such that the longitudinal axis of the resonating element 851 substantially passes through (e.g., is aligned with) the center of the coupling section 91-4. In these cases, for example, the distance between the sidewall of the resonating element 851 (referring to the portion of the sidewall that is adjacent portion A) and the portion A of the coupling section 91-4 and the distance between the sidewall of the resonating element 851 (referring to the portion of the sidewall that is adjacent portion B) and the portion B of the coupling section 91-4 are substantially equal, which makes a first coupling strength between the resonating element 851 and the portion A be equal to a second coupling strength between the resonating element 851 and the portion B. In other words, in these cases, the coupling strengths between the resonating element 851 and various portions of the coupling section 91-4 are substantially equal.

In other cases, the longitudinal axis of the resonating element 851 may not be aligned with the center of the coupling section 91-4 well (e.g., slightly bias) due to for example a manufacture/assembly fault of the resonating element 851 and/or the transmission line 90. In these cases, for example, when the longitudinal axis of the resonating element 851 is biased toward the portion A, the distance between the sidewall of the resonating element 851 and the portion A is smaller than the distance between the sidewall of the resonating element 851 and the portion B, which makes a third coupling strength between the resonating element 851 and the portion A is be greater than a fourth coupling strength between the resonating element 851 and the portion B. The third coupling strength in these cases is greater than the first coupling strength in the above cases, and the fourth coupling strength in these cases is smaller than the second coupling strength in the above cases. This makes the total coupling strength between the resonating element 851 and the entire coupling section 91-4 in these cases be equal to the total coupling strength in the above cases. In other words, the transmission line according to an embodiment of the present invention self-adjusts the coupling between the transmission line and the resonating element in the band-stop filter. For example, although the coupling strength between the resonating element 851 and various portions of the coupling section 91-4 is not equal, the coupling strength between the resonating element 851 and some portions of the coupling section 91-4 increases while the coupling strength between the resonating element 851 and the other portions decreases, such that the total coupling strength between the resonating element 851 and the entire coupling section 91-4 is substantially the same as that in the case where the longitudinal axis of the resonating element 851 passes exactly through the center of the coupling section 91-4. This may loosen the requirements for manufacturing and assembling. It will be appreciated that the portions A and B in the above example may be any two opposite portions of the coupling section 91-4.

The connecting sections 92 of the transmission line 90 include connecting sections 92-1 through 92-3 that are each connected between a pair of adjacent coupling sections 91, and connecting sections that are coupled between the coupling section 91 and the input/output ports (for example, connecting section 92-4 that is coupled between the coupling section 91-4 and the port 63-1). For example, a first end of the connecting section 92-4 is formed as a tapered end 94-2 so as to be coupled to the port 63-1 as described above, and a second end of the connecting section 92-4 is connected to the coupling section 91-4 through a joint C. A first end of the connecting section 92-3 is connected to the coupling section 91-4 through a joint D. A second end of the connecting section 92-3 is connected to the coupling section 91-3 through a joint E, and a first end of the connecting section 92-2 is connected to the coupling section 91-3 through a joint F. Since the coupling section 91 is configured to be substantially annular, the characteristics of various portions of the coupling section 91 are substantially the same, so that those skilled in the art may select the locations of the two joints on the circumference of the same coupling section 91 according to the design requirements of the filter (for example, the positions that the resonating elements are arranged). That is, the joint C and the joint D may be positioned at any two different locations on the outer circumference of the substantially annular coupling section 91-4, respectively, and the joint E and the joint F may be positioned at any two different locations on the outer circumference of the substantially annular coupling section 91-3, respectively. For example, the locations of the two joints may be substantially central symmetrical (e.g., joints E and F) or non-central symmetrical (e.g., joints C and D) with respect to the center of the outer circumference of the substantially annular coupling section 91.

A phase difference that is caused by two paths between a first joint and a second joint on the circumference of the same coupling section 91 (for example, a left path and a right path between the joint C and the joint D) may be calibrated during processing the received and/or transmitted signal by for example baseband processing equipment.

The connecting section 92 for connecting the pair of adjacent coupling sections 91 may extend substantially in a straight line (for example, the connecting section 92-3 that connects the coupling sections 91-4 and 91-3) or may have one or more bends (for example, the connecting section 92-2 that connects the coupling sections 91-3 and 91-2, and the connecting section 92-1 that connects the coupling sections 91-2 and 91-1). The bends may have any suitable shape, such as an S-shape, a right angle and the like. When designing a band-stop filter, the electrical distance between a pair of adjacent resonating elements, which affects a phase difference of a signal that passes on the transmission line from a resonating element to another, should be a desired value. In the case where the electrical distance between the pair of adjacent resonating elements is determined, the connecting section 92 with bend(s) may allow the physical distance between the two resonating elements to be reduced with respect to the connecting section 92 extending in a straight line, which contributes to a compact structure.

Each partition 53 that divides two adjacent cavities 72 may have a recess to accommodate the connecting section 92. Taking the partition 53-1 as an example, as shown in FIG. 4, a first surface of the partition 53-1 that is adjacent the cavity 72-1 has an opening 1 for receiving portion G (shown in FIG. 2) of the connecting section 92-1 of the transmission line 90, and a second surface that is adjacent the cavity 72-2 and opposite the first surface has an opening 2 for receiving portion H (shown in FIG. 2) of the connecting section 92-1. The opening 1 and the opening 2 are staggered, so that the connecting section 92-1 may be allowed to extend not in a straight line. The top surface of the partition 53-1 has a recess 3 for receiving a body portion of the connecting section 92-1. After the top wall of the housing 50 is mounted in position, portions of the top surface of the partition 53-1 other than the recess 3 are in close contact with the top wall, such that the cavities 72-1 and 72-2 each are substantially isolated from each other. The bottom of the recess 3 is provided with a mounting hole 4 and the body portion of the connecting portion 92-1 is provided with a mounting hole 93-1 (see FIG. 6), so that a fastener such as a plastic screw may be used to fix the connecting section 92-1 to the partition 53-1 via the mounting holes 4 and 93-1.

Mounting holes 93-2 through 93-4 (see FIG. 6) are respectively provided in body portions of the connecting sections 92-2 through 92-4 of the transmission line 90 for fixing the connecting sections 92-2 through 92-4 to the respective partitions 53-2, 53-3, 53-1, respectively. In addition, the connecting section 92-4 of the transmission line 90 is further formed with a projection 95 (extending and projecting in the plane in which the transmission line 90 is located), which may be used to support coupled tuning element 83-3 of the first three-port device. The coupled tuning element 83-3 is used to tune the coupling between the first band-pass filter and the first band-stop filter.

In the embodiment shown in the figures, the transmission line 90 is formed as a stripline and is configured to be substantially flat. In other words, various portions of the transmission line 90, including the coupling sections 91 and the connecting sections 92 (even with bend(s)), are substantially in the same plane. This facilitates manufacturing the transmission line 90, for example, the entirety of the transmission line 90 may be formed by a stamping process.

The second band-pass filter is formed in the cavity 74 and includes resonating elements 88-1 through 88-5 (see FIG. 4). Since the configuration of the second band-pass filter is similar to that of the first band-pass filter in the illustrated embodiment, the description of the second band-pass filter is omitted. The second band-stop filter is formed in the cavity 73. The cavity 73 is divided into four substantially isolated cavities 73-1 through 73-4 by partitions 54-1 through 54-3 and 52-2. Mounting portions 87-1 through 87-4 are provided in respective cavities 73-1 through 73-4 to be used to mount corresponding resonating elements, respectively. Since the configuration of the second band-stop filter is similar to that of the first band-stop filter in the illustrated embodiment, the description of the second band-stop filter is omitted.

Figure 10A:
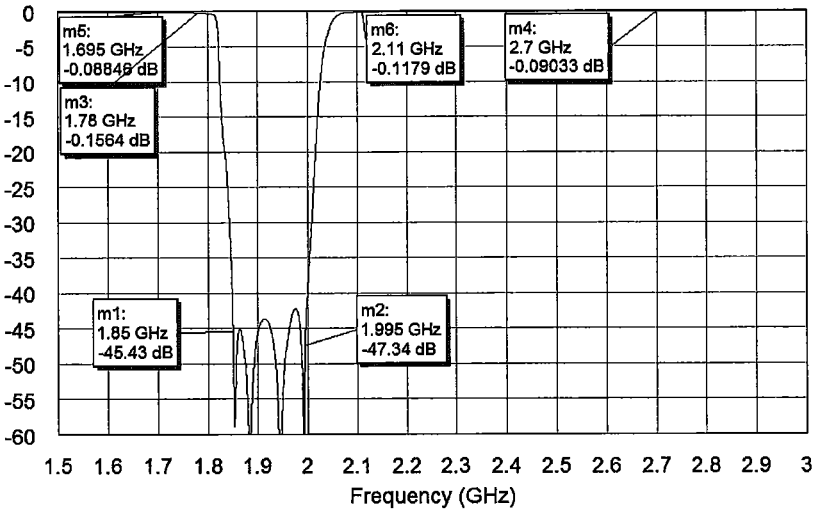
FIGS. 10A through 10C are schematic plots illustrating test parameters of the RF device shown in FIG. 2.
Figure 10B:
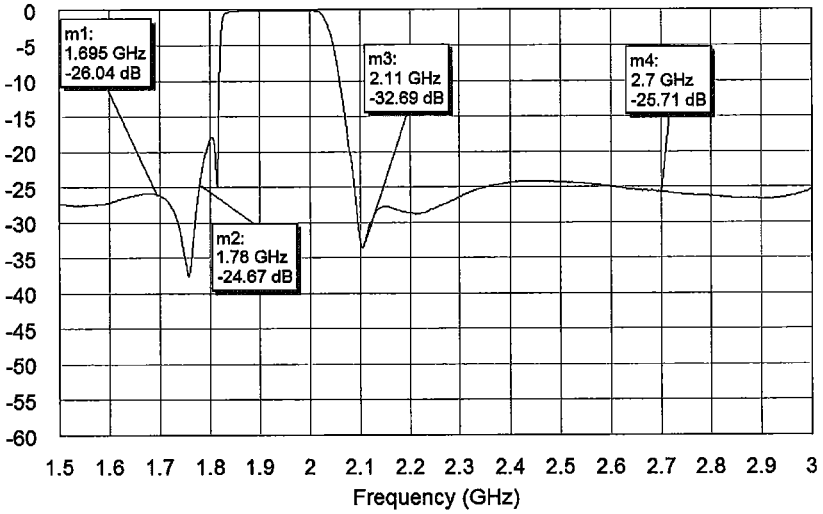
Figure 10C:
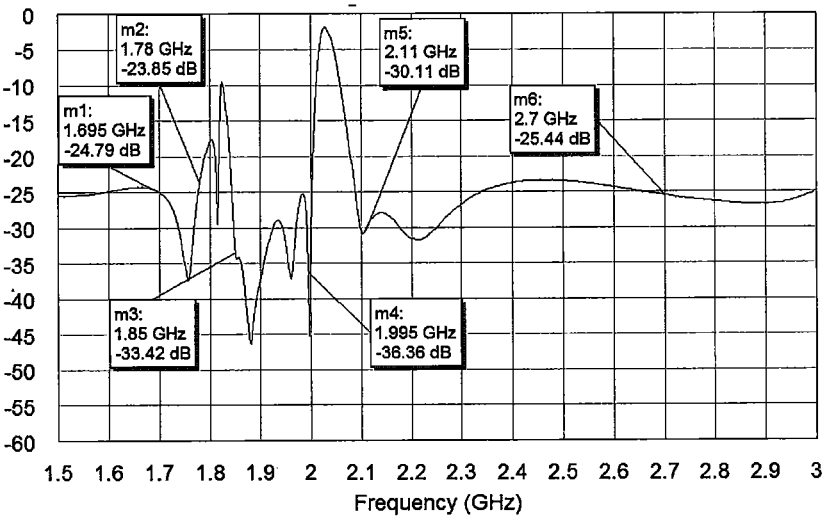

FIGS. 10A through 10C are schematic plots illustrating test parameters of the RF device shown in FIG. 2. FIG. 10A shows the intensity ratio of an output signal to an input signal (i.e., the power of the output signal divided by the power of the input signal) at two ports 63-1 and 61-1 of the first band-stop filter (for example, taking the port 63-1 as an input and the port 61-1 as an output, or taking the port 61-1 as an input and the port 63-1 as an output) as a function of frequency, which may reflect the frequency response of the first band-stop filter. Intensity ratios and corresponding frequencies of six points m1 through m6 on the curve are also shown in the figure. It can be seen that the stop band of the first band-stop filter includes at least the PCS band (between the frequency of 1.85 GHz corresponding to the point m1 to the frequency of 1.995 GHz corresponding to the point m2), and the suppression to signals within the PCS band is greater than 40 dB. At the same time, signals within the AWS1 band (between the frequency of 1.695 GHz corresponding to the point m5 and the frequency of 1.78 GHz corresponding to the point m3) and the AWS2 band (between the frequency of 2.11 GHz corresponding to the point m6 and the frequency of 2.7 GHz corresponding to the point m4) are substantially unsuppressed by the first band-stop filter.

FIG. 10B shows the intensity ratio of a reflected signal to an input signal at the port 61-1 of the first band-stop filter in the RF device as a function of frequency, which may also reflect the frequency response of the first band-stop filter. Intensity ratios and corresponding frequencies of four points m1 through m4 on the curve are also shown in the figure. It can be seen that for the AWS1 band (between the frequency of 1.695 GHz corresponding to the point m1 and the frequency of 1.78 GHz corresponding to the point m2) and the AWS2 band (between the frequency of 2.11 GHz corresponding to the point m3 and the frequency of 2.7 GHz corresponding to the point m4), the intensity ratio of the reflected signal to the input signal is −24 dB or less. Since the intensity of the reflected signal within the two frequency bands is relatively small, signals within the AWS1/2 bands that are input from the port 61-1 are allowed to pass through the RF device and output through another port. For the PCS band, the intensity ratio of the reflected signal to the input signal is 0 dB, that is, the signal within PCS band is almost completely reflected back. That is to say, signals within the PCS band that are input to the port 61-1 are hardly allowed to pass through the RF device.

FIG. 10C shows the intensity ratio of a reflected signal to an input signal at the shared port 63-1 (i.e., the port that is shared by the first band-stop filter and the first band-pass filter) in the RF device as a function of frequency. Intensity ratios and corresponding frequencies of six points m1 through m6 on the curve are also shown in the figure. It can be seen that either for the AWS1 band (between the frequency of 1.695 GHz corresponding to the point m1 and the frequency of 1.78 GHz corresponding to the point m2) and the AWS2 band (between the frequency of 2.11 GHz corresponding to the point m5 and the frequency of 2.7 GHz corresponding to the point m6) or for the PCS band (between the frequency of 1.85 GHz corresponding to the point m3 to the frequency of 1.995 GHz corresponding to the point m4), the intensity ratio of the reflected signal to the input signal is −23 dB or less. This is to say, signals within the three frequency bands that are input to the port 63-1 are allowed to pass through the RF device shown in FIG. 2 and be output by the other ports.

In the above embodiment, the band-stop filter blocks signals within at least the PCS band and passes signals within at least the AWS1/2 bands. It will be appreciated that the band-stop filter may block signals within other frequency bands and/or pass signals within other frequency bands. In the above embodiment, the band-stop filter includes four resonating elements. It will be appreciated that the number of resonating elements in the band-stop filter depends on the width of the stop band of the band-stop filter. Thus, a band-stop filter may include fewer or more resonating elements than four. Accordingly, the transmission line in the band-stop filter includes a corresponding number of coupling sections. In the above embodiment, the band-stop filter is used in a three-port device to operate together with a band-pass filter. It will be appreciated that the band-stop filter may operate together with other filters or other RF devices, or may operate without any filter or RF device.

In the above embodiment, the coupling section of the transmission line has a substantially annular shape that completely surrounds the side of the resonating element. It will be appreciated that in some embodiments, the coupling section of the transmission line may be other shapes that completely surround the side of the resonating element. The other shapes may be planar shapes, such as elliptical rings, triangles, rectangles, other polygons and the like, or may be three-dimensional shapes, for example a cylindrical shape having a circular, elliptical, triangular, rectangular or another polygonal cross section. In other embodiments, the coupling section of the transmission line may partially surround the side of the resonating element.

Figure 7:
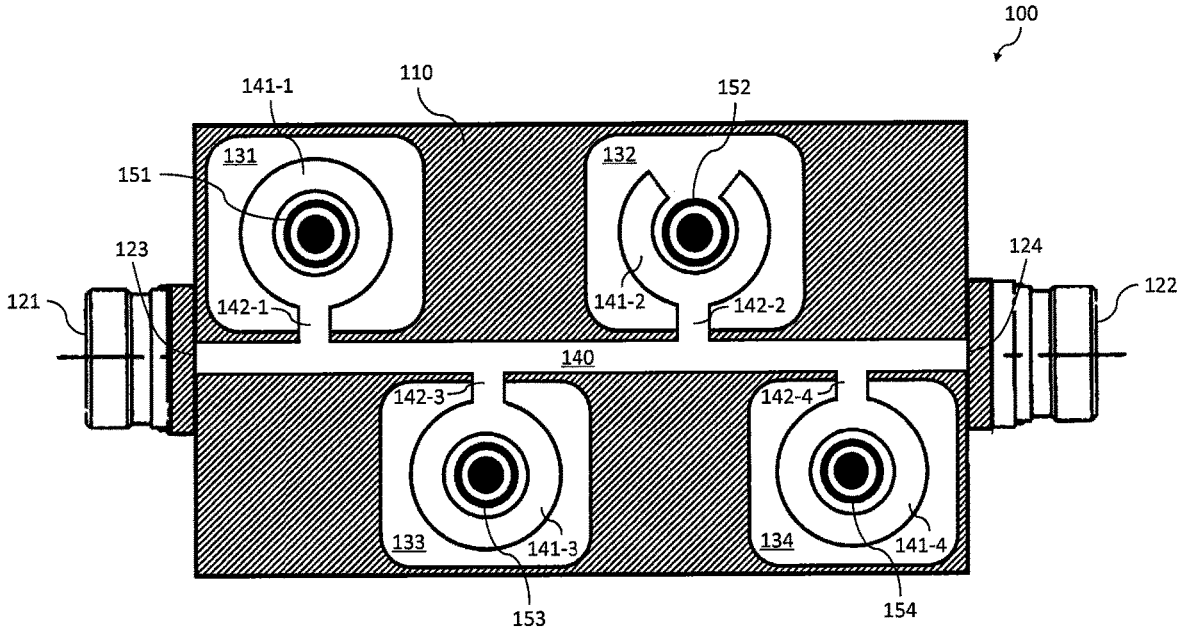
FIG. 7 is a highly simplified schematic top view of a band-stop filter according to a further embodiment of the present invention.

As shown in FIG. 7, a band-stop filter 100 according to a further embodiment of the present invention includes a housing 110 in which four cavities 131 through 134 are formed. Resonating elements 151 through 154 are respectively positioned in the cavities 131 through 134 to resonate at respective resonant frequencies. A transmission line 140 has a main line that is coupled between an input port 123 and an output port 124 in a straight line. Ports 123 and 124 are connected to external cables through connectors 121 and 122, respectively. The transmission line 140 further includes four branches extending from the main line into the respective four cavities 131 through 134. These branches each include respective coupling sections 141-1 through 141-4 that are coupled to the resonating elements 151 through 154, respectively, and connecting sections 142-1 through 142-4 that connect the coupling sections 141-1 through 141-4 to the main line, respectively. The coupling section 141 may be configured to be a substantially annular shape that completely surround the side of the resonating element (see resonating elements 151, 153, 154), for example the coupling section 141-1, 141-3, 141-4, or may be configured to be a substantially annular sector that partially surround the side of the resonating element 152, for example the coupling section 141-2.

Figure 8:
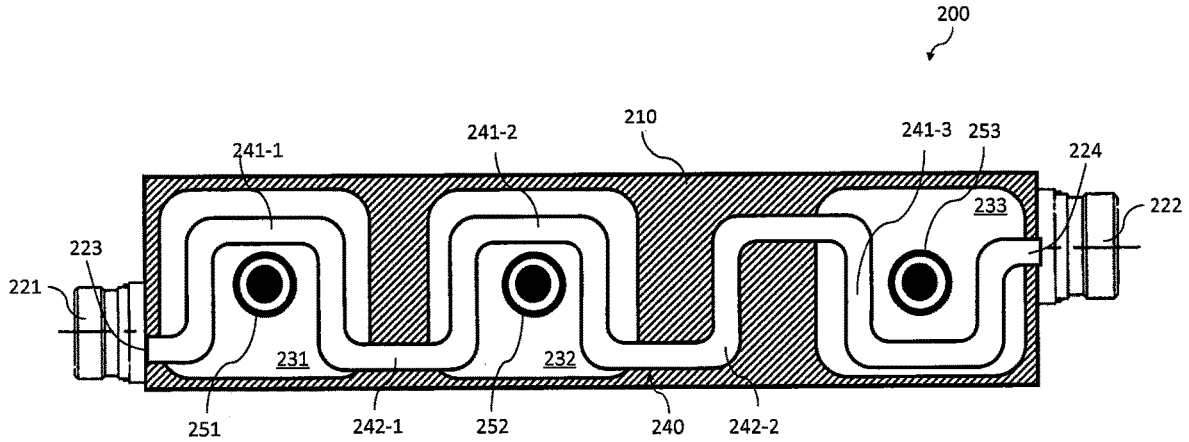
FIG. 8 is a highly simplified schematic top view of a band-stop filter according to a further embodiment of the present invention.

As shown in FIG. 8, the band-stop filter 200 according to a further embodiment of the present invention includes a housing 210 in which three cavities 231 through 233 are formed. Resonating elements 251 to 253 are respectively positioned in the cavities 231 through 233 to resonate at respective resonant frequencies. A transmission line 240 is coupled between an input port 223 and an output port 224. Ports 223 and 224 are connected to external cables through connectors 221 and 222, respectively. The transmission line 240 includes coupling sections 241-1 through 241-3 that are coupled to the resonating elements 251 through 253, respectively. The coupling sections 241-1 through 241-3 that are configured to partially surround the sides of the resonating elements 251 through 253. The transmission line 240 further includes connecting sections 242-1 and 242-2 that connect the adjacent coupling sections 241, respectively. The connecting section 242-1 extends in a straight line. The connecting section 242-2 has bends, which may be designed according to the space of the band-stop filter 200 and the desired electrical distance between the adjacent resonating elements 252 and 253.

In the above embodiments, resonating elements in the band-stop filters each have a circular (or annular) cross section. It will be appreciated that the present invention does not limit the shape of the resonating element, and the shape of the resonating element may be designed according to actual demand.

Although some specific embodiments of the present invention have been described in detail with examples, it should be understood by a person skilled in the art that the above examples are only intended to be illustrative but not to limit the scope of the present invention. The embodiments disclosed herein can be combined arbitrarily with each other, without departing from the scope and spirit of the present invention. It should be understood by a person skilled in the art that the above embodiments can be modified without departing from the scope and spirit of the present invention. The scope of the present invention is defined by the attached claims.

That which is claimed is:

1. A band-stop filter comprising:

a housing comprising a top wall, a bottom wall and at least one side wall, the housing defining an internal cavity;

a signal input port that is disposed on one of the at least one side wall;

a signal output port that is disposed on one of the at least one side wall;

a resonating element that is disposed in the internal cavity and includes a top, a bottom, and a side; and a transmission line that is disposed in the internal cavity and coupled between the signal input port and the signal output port, the transmission line comprising a coupling section that is coupled to the resonating element, wherein the transmission line is entirely spaced apart from the top wall, the bottom wall, and the at least one side wall of the housing, and wherein the coupling section is configured to surround more than half of the side of the resonating element and not directly contact the housing and the resonating element.

2. The band-stop filter according to claim 1, wherein the coupling section is configured to completely surround the side of the resonating element.

3. The band-stop filter according to claim 2, wherein the coupling section is configured to be substantially annular and substantially parallel to the bottom wall.

4. The band-stop filter according to claim 3, wherein the resonating element is a coaxial resonating element whose longitudinal axis is substantially perpendicular to the bottom wall, and the resonating element and the transmission line are positioned such that the longitudinal axis of the coaxial resonating element substantially passes through a center of the coupling section.

5. The band-stop filter according to claim 3, wherein the transmission line further comprises a first connecting section and a second connecting section, wherein the coupling section is connected to the first connecting section through a first joint and coupled to the signal input port via the first connecting section, wherein the coupling section is connected to the second connecting section through a second joint and coupled to the signal output port via the second connecting section, and wherein the first joint and the second joint are positioned at different locations on an outer circumference of the substantially annular coupling section.

6. The band-stop filter according to claim 5, wherein the first joint and the second joint are non-centrosymmetric with respect to a center of an inner circumference of the substantially annular coupling section.

7. The band-stop filter according to claim 5, wherein the transmission line is coupled between the signal input port and the signal output port sequentially through the first connecting section, the coupling section and the second connecting section.

8. The band-stop filter according to claim 3, wherein the resonating element is a first resonating element, the coupling section is a first coupling section, and the band-stop filter further comprises a second resonating element, the transmission line further comprises a second coupling section, the second coupling section is configured to be substantially annular and completely surround a side of the second resonating element and not directly contact the housing and the second resonating element, wherein the second coupling section and the first coupling section are positioned on a common plane.

9. The band-stop filter of claim 8, wherein the housing further comprises a partition extending upwardly from the bottom wall into the internal cavity so as to define first and second cavities within the internal cavity, the first and second cavities are located on opposite sides of the partition and substantially isolated from each other, and the first resonating element is disposed within the first cavity along with the first coupling section and the second resonating element is disposed within the second cavity along with the second coupling section.

10. The band-stop filter according to claim 9, wherein the first resonating element and the second resonating element are adjacent one another, and the transmission line further comprises a connecting section that is configured to connect the first coupling section to the second coupling section and is positioned on the common plane, and wherein the connecting section has a bend.

11. The band-stop filter according to claim 10, wherein an upper end of the partition includes a recess to accommodate the connecting section.

12. The band-stop filter according to claim 1, wherein the transmission line comprises a stripline transmission line.

13. The band-stop filter according to claim 1, wherein the bottom of the resonating element is fixed to the bottom wall, the top of the resonating element has an upward opening, and an upper edge of the resonating element has an outward flange that has a lower surface that is opposite an upper surface of the coupling section.

14. The band-stop filter according to claim 13, wherein the flange and the coupling section overlap in a plan view that is parallel to the bottom wall.

15. A transmission line for a band-stop filter, the band-stop filter including a housing that defines an internal cavity, a signal input port and a signal output port that are disposed on the housing, and a resonating element a transmission line that are disposed in the internal cavity, wherein the transmission line is coupled between the signal input port and the signal output port and includes a coupling section that is configured to be substantially parallel to a bottom wall of the housing, substantially annular, and to completely surround a side of the resonating element, and to not directly contact the housing and the resonating element, such that the transmission line is coupled to the resonating element through the coupling section, wherein the resonating element extends upward from a floor of the internal cavity and includes an upper portion and a lower portion, and wherein the coupling section of the transmission line extends around the upper portion of the resonating element.

16. The transmission line according to claim 15, wherein the transmission line further comprises a first connecting section and a second connecting section, wherein the coupling section is connected to the first connecting section through a first joint and coupled to the signal input port via the first connecting section, wherein the coupling section is connected to the second connecting section through a second joint and coupled to the signal output port via the second connecting section, and wherein the first joint and the second joint are positioned at different locations on an outer circumference of the substantially annular coupling section.

17. A band-stop filter comprising:

a housing defining an internal cavity;

a signal input port on the housing;

a signal output port on the housing;

a resonating element in the internal cavity; and a transmission line in the internal cavity and coupled between the signal input port and the signal output port, the transmission line including a coupling section and being coupled to the resonating element through the coupling section, wherein the coupling section includes a first portion that partially surrounds the resonating element on a first side thereof and a second portion that partially surrounds the resonating element on a second side thereof that is opposite the first side, and a first end of the first portion and a first end of the second portion are connected by a first joint, wherein an upper edge of the resonating element has an outward flange that has a lower surface that is opposite an upper surface of the coupling section, and wherein the flange and the coupling section overlap in a plan view that is parallel to a bottom wall of the housing.

18. The band-stop filter according to claim 17, wherein a second end of the first portion and a second end of the second portion are connected by a second joint.

19. The band-stop filter according to claim 18, wherein the transmission line further includes a first connecting section and a second connecting section, wherein the coupling section is connected to the first connecting section through the first joint and coupled to the signal input port via the first connecting section, and wherein the coupling section is connected to the second connecting section through the second joint and coupled to the signal output port via the second connecting section.

20. The band-stop filter according to claim 19, wherein a length of the first portion is different than that of the second portion.

* * * * *